US005194168A

United States Patent [19]

Aoki et al.

[11] Patent Number: 5,194,168

[45] Date of Patent: Mar. 16, 1993

[54] LUBRICANT COMPOSITIONS

[75] Inventors: Nobuo Aoki; Shinichiro Suzuki, both of Yokohama, Japan

[73] Assignee: Nippon Oil Co., Ltd., Japan

[21] Appl. No.: 646,655

[22] Filed: Jan. 28, 1991

[30] Foreign Application Priority Data

Jan. 29, 1990 [JP] Japan ..... 2-18496

[51] Int. Cl.[5] ..... C10M 143/12; C10M 143/00

[52] U.S. Cl. ..... 252/50; 252/52 R; 252/56 D; 585/10; 585/13

[58] Field of Search ..... 585/10, 13; 252/50, 252/52 R

[56] References Cited

U.S. PATENT DOCUMENTS

| | | | |
|---|---|---|---|
| 3,795,615 | 3/1974 | Pappas et al. | 585/13 |
| 3,959,161 | 5/1976 | Dawans et al. | 585/13 |
| 4,021,207 | 5/1977 | Durand et al. | 585/13 |
| 4,082,680 | 4/1978 | Mitacek | 585/13 |

*Primary Examiner*—Ellen McAvoy

*Attorney, Agent, or Firm*—Bruce L. Adams; Van C. Wilks

[57] ABSTRACT

Lubricant compositions of high lubrication and light coloration characteristics are made up essentially of a selected mineral or synthetic oil and a selected polybutadiene. The polymeric component contains greater than 20% by mol of vinyl bonds in terms of its monomeric unit and has crosslinked more than 10% of the vinyl bond content.

7 Claims, 2 Drawing Sheets

LUBRICANT COMPOSITIONS

BACKGROUND OF THE INVENTION

1. Field of the Invention

This invention relates to lubricant compositions providing lubricating oils suitable for use as engine oil, hydraulic fluid, gear oil, bearing oil and the like.

2. Prior Art

Higher lubricating qualities; i.e. resistance to high pressure and to wear, have been recently called for in the area of lubricating oils and greases. To this end, the tendency is that a given base oil is blended with some inorganic solid lubricants such as molybdenum disulfides, tungsten disulfides and graphites. These additives are however responsible for the blackish unsightly appearance of the resulting lubricant.

SUMMARY OF THE INVENTION

The present invention seeks to provide a novel lubricant composition which has high lubricating qualities coupled with light colored product appearance.

According to the invention, there is provided a lubricant composition comprising a base oil of mineral or synthetic origin and a hardened compound resulting from crosslinking more than 10% of vinyl double bonds in a polybutadiene having more than 20 mol % of vinyl double bonds in terms of its monomer unit, said hardened compound being added in an amount of 0.01–50 parts by weight per 100 parts by weight of said base oil.

It has now seen found surprisingly that the above features of the lubricant composition can be achieved by blending a base oil with a specific hardened compound resulting from crosslinking a class of polybutadienes.

DETAILED DESCRIPTION OF THE INVENTION

Figure 1:
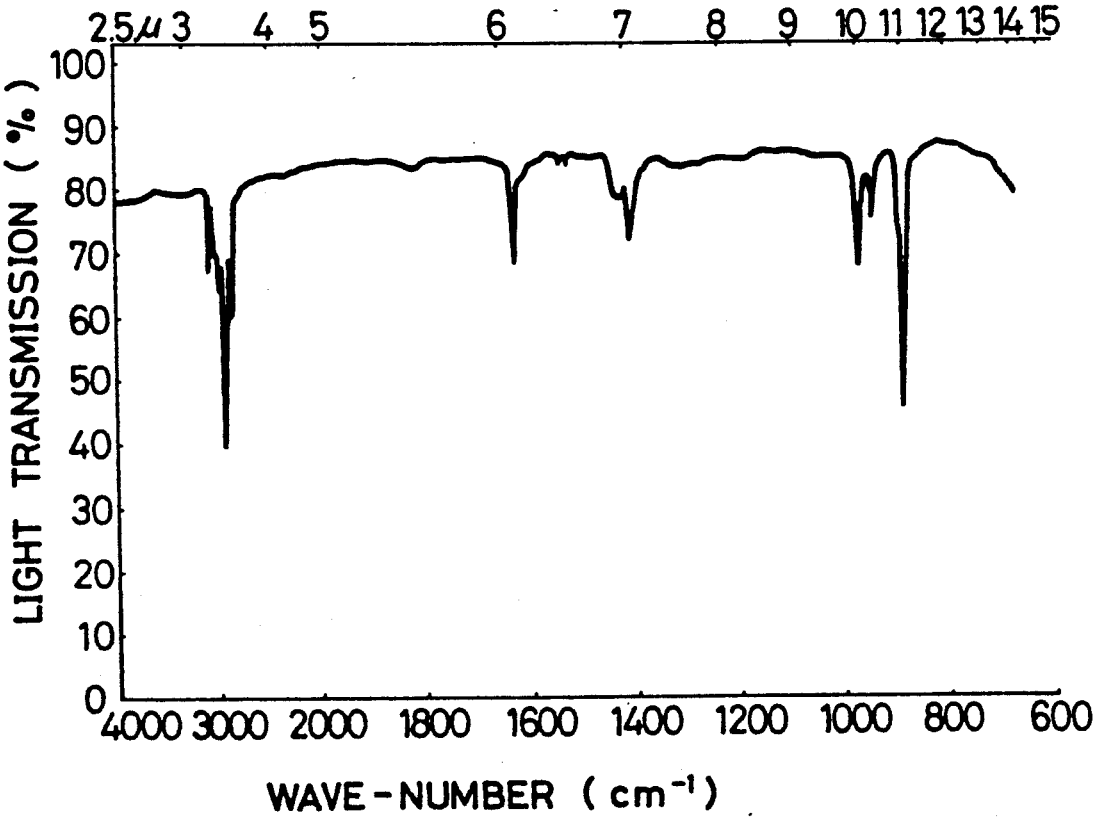
FIGS. 1 and 2 are graphs respectively showing infrared spectroscopic analysis of the inventive hardened compound before and after being hardened.

The term polybutadiene as used herein designates a a polymer derived from subjecting a butadiene to polymerization such as anionic polymerization using catalysts of for example Na dispersants and organoalkalimetallic compounds, radical polymerization with catalysts of organoperoxides, cationic polymerization with Friedel-Crafts catalysts and anionic coordination reaction with Ziegler-type catalysts.

Polybutadienes contain backbone (trans- and cis-) double bonds in addition to vinyl double bonds. The polybutadiene used in the invention contains vinyl double bonds in an amount of more than 20 mol %, preferably more than 40 mol %, more preferably more than 50 mol % and most preferably more than 70 mol % in terms of the monomer unit.

The term hardened compound as used herein refers to a hardened product resulting from crosslinking more than 10%, preferably more than 40%, more preferably more than 70% and most preferably more than 90% of the vinyl double bonds in the above defined polybutadiene.

The rate of reaction of the vinyl double bonds according to the invention is represented by the formula $$\text{Reaction Rate (\%)} = \frac{A - B}{A} \times 100$$

where A is the amount of vinyl double bonds in the polybutadiene as determined by infrared spectroscopic analysis and B is the amount of vinyl double bonds in the polybutadiene after being hardened.

The polybutadiene used in the invention has a number average molecular weight of 500–100,000, preferably 1,000–20,000, and more preferably 1,500–8,000. Smaller than 500 molecular weights would retard the hardening speed, while greater than 100,000 molecular weights would result in objectionably viscous product.

The polybutadiene according to the invention includes copolymers having monomers other than the butadiene unit in the polymer skeleton. Such comonomers are for example styrene, alpha-methylstyrene and acrylonitrile, of which styrene is particularly preferred. In any case, however, such copolymers should contain vinyl double bonds in an amount of more than 20 mol %, preferably more than 40 mol %, more preferably more than 50 mol % and most preferably more than 60 mol % in terms of the total monomer unit including the comonomer.

The polybutadiene according to the invention may, if desired, be modified with acids or peroxides to introduce hydroxyl groups or carboxyl groups in the polymer. For instance, the polymer may be added with maleic anhydride, or may have intercarbon double bonds epoxidized. In any case however, the polymer should contain vinyl double bonds in an amount of more than 20 mol %, preferably more than 40 mol %, more preferably more than 50 mol % and most preferably more than 60 mol % in terms of the monomer unit.

The hardened compound referred to herein may be obtained by various processes. It may for example be derived from subjecting the inventive polybutadiene to a radical hardening reaction preferably in the presence of suitable radical initiators. Examples of such radical initiators include organic peroxides such as methyl ethyl ketone peroxide, 1,1-bis(t-butylperoxy)3,3,5-trimethylcyclohexane, t-butylhydro peroxide, dicumyl peroxide, 2,5-dimethyl-2,5-di(t-butylperoxy)hexyne-3 and the like, and aromatic hydrocarbons such as 2,3-dimethyl-2,3-diphenylbutane, 2,3-diethyl-2,3-diphenylbutane and the like. Particularly preferred are 2,5-dimethyl-2,5-di(t-butylperoxy)hexyne-3, 2,3-dimethyl-2,3-diphenylbutane and 2,3-diethyl-diphenylbutane, of which 2,3-dimethyl-2,3-diphenylbutane is best chosen.

Reaction temperature for radical hardening of the polybutadiene according to the invention varies with the decomposition temperature of the initiator used but is usually in the range of 50°–350° C., preferably 150°–330° C., more preferably 240°–320° C., and most preferably 250°–310° C. Reaction time, though dependent upon temperature, is usually in the range of 10 minutes to 10 hours, preferably 20 minutes to 3 hours.

The hardened compound according to the invention may be in various forms but is preferably in the form of fine particles having a particle size of less than 100 μm, preferably less than 10 μm, more preferably less than 1 μm. It may be prepared by mechanical pulverization or by hardening while in an emulsified state.

The base oil for the inventive composition may be any commercially available lubricant base oil regardless of whether it may be mineral or synthetic.

Mineral oils may be atmospheric or vacuum distillates which are subjected to solvent deasphalting, solvent extraction, hydrocracking, solvent dewaxing, hydrodewaxing, sulfur acid treatment, clay refining, hydrorefining and the like.

Eligible synthetic lubricant base oils include alpha-olefin oligomers such as normal paraffin, isoparaffin, polybutene, polyisobutylene, 1-decene oligomer and the like, alkylbenzenes such as monoalkylbenzene, dialkylbenzene polyalkylbenzene and the like, alkyl naphthalenes such as monoalkyl naphthalene, dialkyl naphthalene, polyalkyl naphthalene and the like, diesters such as di-2-ethylhexyl sebacate, dioctyl adipate, diisodecyl adipate, ditridecyl adipate, ditridecyl glutarate and the like, polyol esters such as trimethylolpropane caprylate, trimethylolpropane pelargonate pentaerythritol-2-ethyl hexanoate, pentaerythritol pelargonate and tyhe like, polyglycols such as polyethylene glycol, polyethylene glycol monoether, polypropylene glycol, polypropylene glycol monoether and the like, polyphenyl ether, tricresyl phosphate and silicone oil.

The above base oils may be used singly or in combination.

The lubricant compositions of the invention are characterized by blending the base oils with the hardened compound which is used in an amount of 0.01–50, preferably 0.1–20 and more preferably 0.3–10 parts by weight per 100 parts base oil. The hardened compound, if used in amounts smaller than 0.01 weight part, would lead to poor lubricating performance and, if greater than 50 weight parts, would not be sufficiently dispersed in the base oil.

The inventive lubricant compositions may also be blended with various additives such as antioxidants, detergent dispersants, viscosity index improvers, pour point depressants, antiwear agents, extreme pressure additives, oiliness agents, corrosion inhibitors, metal inactivators, rust inhibitors, defoamers, emulsifiers, demulsifiers, disinfectants, colorants and the like.

Gelling agents may also be used to turn the compositions into greases.

Details as regards the above listed additives are disclosed for instance in J. Soc. Lubricants, Japan, Vol. 15, No. 6 and "Additives for Petroleum Products" edited by Toshio Sakurai, Saiwai Publishing Co., Japan. Suitable additives may be chosen to suit application of the inventive lubricant composition as engine oil, hydraulic fluid, gear oil, bearing oil or the like.

The invention will be further described by way of the following examples.

Figure 2:
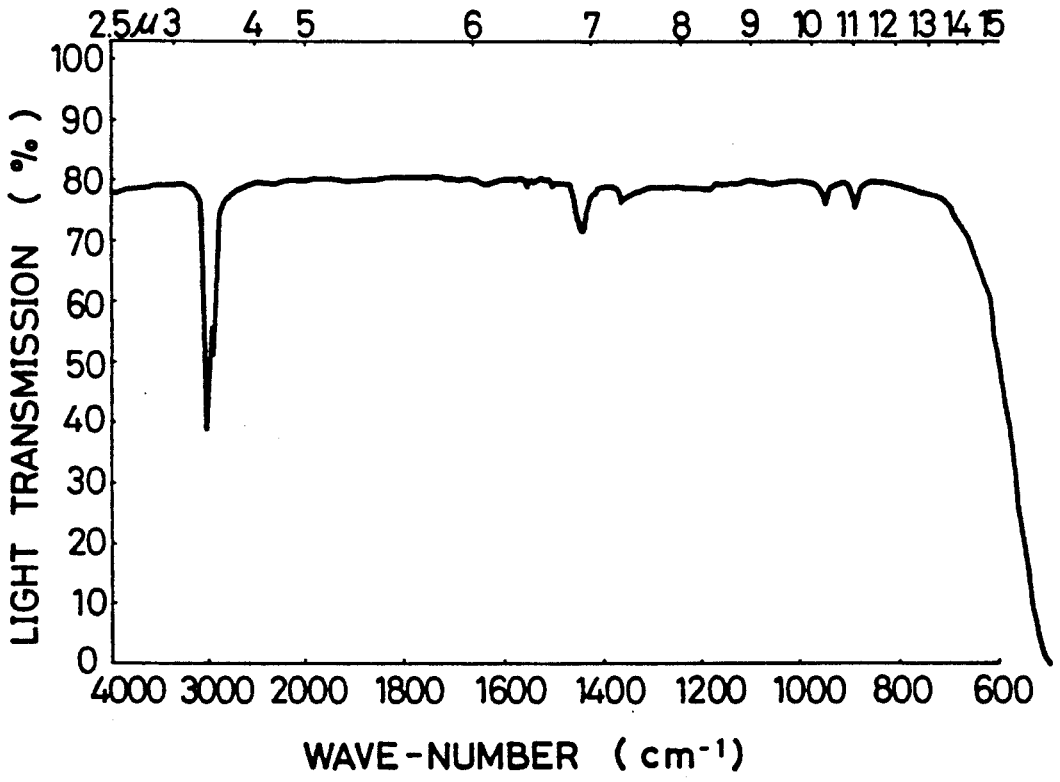

PREPARATION OF HARDENED COMPOUND 100 parts by weight of liquid polybutadiene having a number average molecular weight of 3,000, 65 mol % or more of vinyl double bonds and a viscosity of 500 poise at 25° C. were added with 1.0 part by weight of 2,3-dimethyl-2,3-diphenylbutane, followed by heating with stirring at 80° C. The resulting admixture was coated uniformly over a NaCl plate with use of a spinner and sandwiched by another NaCl plate. This starting sample was analyzed by an infrared spectroscopic analyzer with the results shown in FIG. 1. The sample was heated for two hours in a constant temperature vessel having a controlled temperature of 290° C. and purged with nitrogen. The resulting hardened material was infrared spectroscopically analyzed with the results shown in FIG. 2 wherein absorption of vinyl double bonds is at 910 $cm^{-1}$.The rate of reaction of vinyl double bonds as determined by Lambert-Beer's law with a reference absorption at 2,900 $cm^{-1}$ was 90.4%. The sample was then placed in a brass mold and heated in a 290° C. constant temperature vessel for two hours. The resulting hardened product was ground by a shock-type ultrafine pulverizer to an average particle size of 16 μm and classified by a high-precision pneumatic classifier to obtain an average particle size 1.4 μm.

INVENTIVE EXAMPLE 1.0 part by weight of the hardened compound prepared as above was added to 100 parts by weight of pentaerythritol pelargonate (synttetic base oil). The admixture was stirred at room temperature to obtain a pale uniform dispersion. This dispersion was tested for lubricating qualities by Falex pin block tester at 80° C. with a load of 250 pounds for one hour. Pin wear was 1.4 mg. Seisure load was 1,430 pounds.

COMPARATIVE EXAMPLE 1

The procedure of the above Inventive Example was followed except for the use of 1.0 part by weight of particulate polytetrafluoroethylene having an average particle size of 1.3 μm in place of the hardened particulate compound of the invention.

COMPARATIVE EXAMPLE 2

The procedure of Inventive Example was followed except for the use of 1.0 part by weight of molybdenum disulfide having an average particle size of 0.3 μm in place of the inventive hardened compound.

COMPARATIVE EXAMPLE 3

The procedure of Inventive Example was followed except for the use of 1.0 part by weight of liquid polybutadiene in place of the inventive hardened compound.

Lubricating quality test data on each of the above examples are shown in the following table.

TABLE

| | Pin Wear (mg) | Seizure Load (lb) | Appearance |
|---|---|---|---|
| Inventive Example 1 | 1.4 | 1,430 | pale |
| Comparative Example 1 | 36.5 | 860 | pale |
| Comparative Example 2 | 1.5 | 1,410 | blackish |
| Comparative Example 3 | 31.6 | 980 | pale |

What is claimed is:

1. A lubricant composition comprising a base oil of mineral or synthetic origin and a hardened compound resulting from crosslinking more than 10% of vinyl double bonds in a polybutadiene having more than 20 mol % of vinyl double bonds in terms of its monomer unit, said hardened compound being added in an amount of 0.01–50 parts by weight per 100 parts by weight of said base oil.

2. A lubricant composition according to claim 1 wherein said polybutadiene has a number average molecular weight of 500–100,000.

3. A lubricant composition according to claim 1 wherein said hardened compound has an average particle size of less than 100 μm.

4. A lubricant composition according to claim 1 wherein said polybutadiene includes copolymers having monomers other than the butadiene unit in the polymer skeleton and containing vinyl double bonds in an account of more than 20 mol % in terms of the total monomer unit.

5. A lubricant composition according to claim 4 wherein said monomers include styrene, alpha-methylstyrene and acrylonitrile.

6. A lubricant composition according to claim 3, wherein the average particle size is less than 10 μm.

7. A lubricant composition according to claim 3, wherein the average particle size is less than 1 μm.

* * * * *